United States Patent [19]

Nidelkoff

[11] 3,958,349

[45] May 25, 1976

[54] TELESCOPING SUPPORT FOR ELEVATED SIGNBOARD

[75] Inventor: James G. Nidelkoff, White Bear Lake, Minn.

[73] Assignee: Minnesota Mining and Manufacturing Company, St. Paul, Minn.

[22] Filed: June 26, 1975

[21] Appl. No.: 590,721

[52] U.S. Cl. ..... 40/125 H; 248/333

[51] Int. Cl.² ..... G09F 7/00

[58] Field of Search ..... 40/125 R, 125 H, 125 K, 40/128; 248/333

[56] References Cited

UNITED STATES PATENTS

| | | | |
|---|---|---|---|
| 1,242,125 | 10/1917 | Bean | 248/333 |
| 2,512,519 | 6/1950 | Covington | 40/125 K |
| 2,515,978 | 7/1950 | Baurs | 40/125 K |
| 2,522,157 | 9/1950 | Baurs et al. | 40/125 K |
| 3,609,898 | 10/1971 | Brown | 40/125 H |
| 3,824,726 | 7/1974 | Schubert | 40/132 R |
| 3,887,155 | 6/1975 | Bertalot | 248/333 |

*Primary Examiner*—Louis G. Mancene
*Assistant Examiner*—Wenceslao J. Contreras
*Attorney, Agent, or Firm*—Alexander, Sell, Steldt & DeLaHunt

[57] ABSTRACT

A support for a screen printed transparency or other photographic art work which may be raised on a track from a lowered ground level position to an upper position in a frame mounted on an elevated illuminated signboard. The support is fixed in the frame on the elevated signboard when raised.

4 Claims, 4 Drawing Figures

TELESCOPING SUPPORT FOR ELEVATED SIGNBOARD

BACKGROUND OF THE INVENTION

1. Field of the Invention

This invention relates to an improvement in signboards and particularly to an improved structure for positioning photographic copy on a signboard.

2. Description of the Prior Art

Prior to the present invention photographic art work for illuminated signboards was positioned in the holder on the signboard by the person climbing a ladder to the holder on the signboard, bringing the holder down, removing one piece of photographic art work and inserting the desired piece of photographic art work, and returning the holder and fixing it on the sign. This requires carrying to the signboard not only the art work but also a ladder to reach the holder on the illuminated sign. This causes additional work on the part of the person changing the sign and lost time. Further, there is always a potential safety hazard when one has to climb a ladder and work above ground.

It is therefore an object of the present invention to provide an improved support frame for photographic art work for use with illuminated signboards which are positioned above ground and adjacent a roadway to permit the signboard to feature varying messages throughout the day for example, breakfast, lunch, cocktails, dinner, and entertainment. Thus, five trips to the signboard to change the photographic art work must be made in the shortest possible time to most effectively utilize the time of the person changing the art work and to make such signs of interest to the various proprietors.

SUMMARY OF THE PRESENT INVENTION

The present invention is directed to an advertising sign frame structure supported on the face of an elevated illuminated sign and including a frame for framing a rectangular shaped area. The frame may be attached to the rails positioned across the face of the elevated sign in a conventional manner permitting the entire frame to be removed from the illuminated signboard. Supported by the frame is a secondary rectangular frame structure. The secondary frame is provided with resilient supporting clips to which the photographic art work may be readily attached and detached and secured. The secondary frame is formed preferably of tubular aluminum material and is joined to the first frame by telescoping tubular members connected to the tubes of the secondary frame and a tube secured to the upper structural member of the primary frame. The telescoping tube includes two or more lengths of tube stock which are interconnected between the upper structural member of the first frame and the tubular side members of the secondary frame. The secondary frame is provided with fastening members which cooperate with fastening members on the primary frame affording a secure fastening for the secondary frame in the primary frame and which permit release by engagement of the secondary frame and movement thereof by a rod which may be attached to the secondary frame. The secondary frame is formed with a hook or openings to which the rod having a mating end may be engaged to control the secondary frame.

DESCRIPTION OF THE DRAWING

The present invention will be more fully understood after the perusal of the following description which refers to the accompanying drawing wherein.

DESCRIPTION OF THE PRESENT INVENTION

Figure 1:
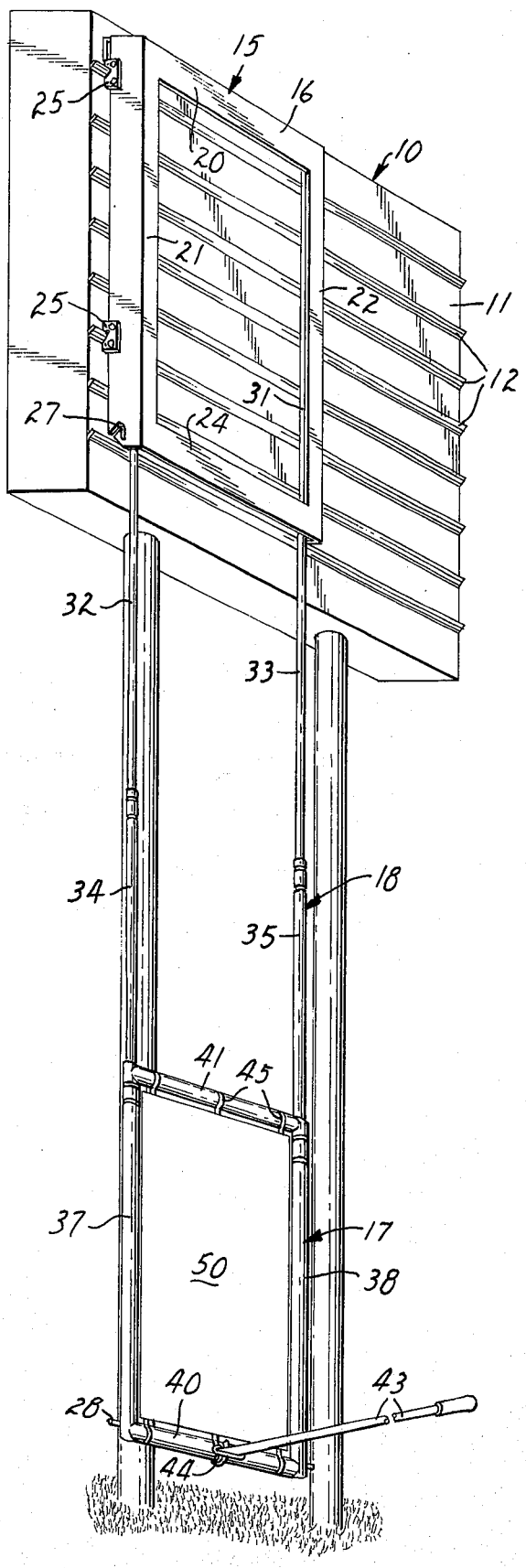
FIG. 1 is a perspective view of an elevated illuminated signboard having mounted thereon a photographic art support frame constructed in accordance with the present invention.
Figure 2:
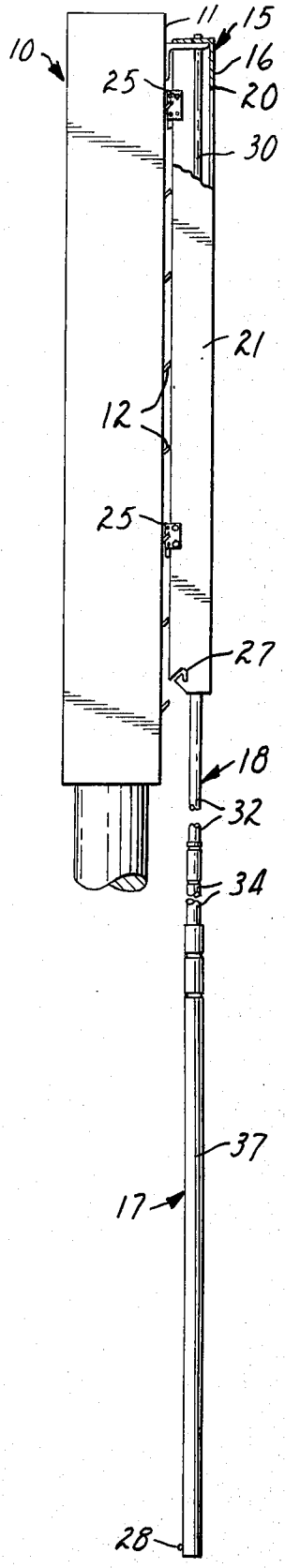
FIG. 2 is a side elevational view of the signboard and frame of the present invention with portions thereof broken away to illustrate interior parts and with portions broken to eliminate the necessity of showing the entire length of the part.
Figure 3:
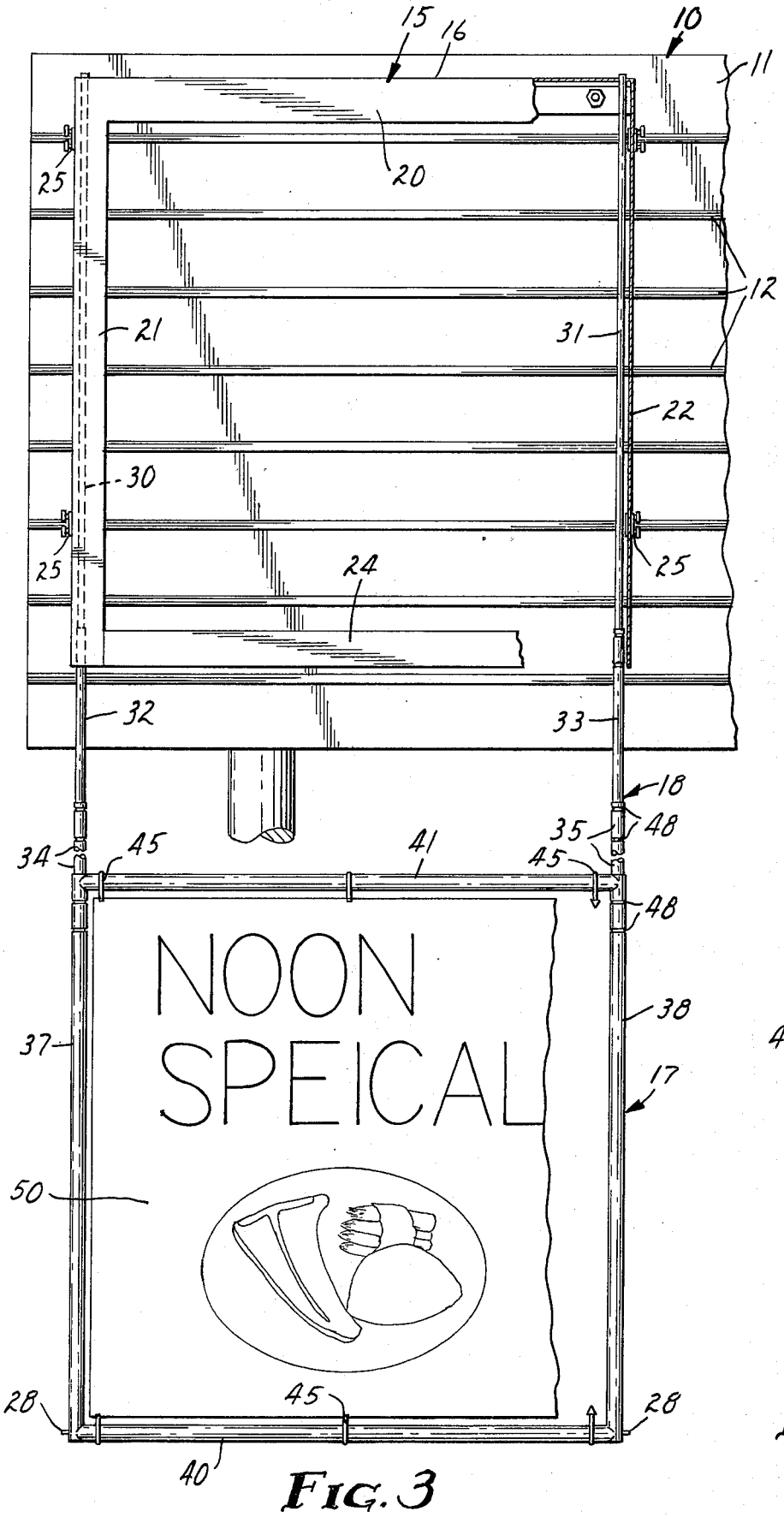
FIG. 3 is a front elevational view of the signboard in the frame structure for the art work formed in accordance with the present invention showing again portions broken away to illustrate interior members.

The preferred embodiment of the present invention is illustrated in the accompanying drawings wherein like reference numerals refer to like parts throughout the several views.

The present invention is directed to a frame which may be attached to illuminated signboards of a conventional construction such as illustrated by the reference numeral 10 having interior lights which project through a translucent panel 11 across which extend parallel rail members 12 upon which removable letters may be easily attached by brackets all as illustrated in U.S. Pat. No. 3,831,895, issued Aug. 27, 1974.

The frame of the present invention may be secured over a portion of the surface of the panel 11 and secured to the rails 12 by attachment brackets corresponding to the brackets of U.S. Pat. No. 3,831,895. Suitable lock means are provided for the attachment brackets such that the art work frame structure of the present invention will not be displaced unintentionally.

The frame for supporting the art work of the present invention is illustrated generally by the reference numeral 15 and comprises a primary frame structure 16, a secondary frame structure 17 and a plurality of telescoping supports or rail members 18.

The primary frame structure 16 adapted to be supported on the illuminated panel 11 comprises three angle structured members 20, 21 and 22 coupled together to form, together with a bar 24, a rectangular structure having top and side portions thereof extending outwardly from the face of the illuminated panel 11 and front portions disposed generally horizontal thereto to form an esthetic facade about a piece of photographic art work which may be placed between said horizontally disposed portions and said panel. The side frame members 21 and 22 are each provided with attachment brackets 25 to support the frame 16 on the support bars 12. The lower portion of the frame members 21 and 22 are also provided with fastening means in the form of slots 27 which extend inwardly and downwardly from the rear of the side members to receive a fastening member secured to the secondry frame 17 in the form of pins 28. The corners of the side panels 21 and 22 have the lower portions thereof truncated to permit the movement of the fastening members 28 behind the frame to be aligned with the slots 27 and placed therein.

Supported from the upper frame member 20 on the portion thereof perpendicular to the panel 11 is a pair of tubes 30 and 31 which form part of the guide rails 18 for the secondary frame 17 of the structure of the present invention. These members are adapted to cooperate telescopically with tubular members 32 and 33 which are in turn adapted to cooperate telescopically with additional tubes 34 and 35. The tubular members 34 and 35 cooperate telescopically with side members 37 and 38 of the secondary frame 17. The members 37 and 38 are joined by parallel bars 40 and 41 which extend therebetween and connect the ends of the members 37 and 38 to define a rectangular area in which a photographic transparency 50 may be supported by suitable resilient fastening members or clamps 45 supported by the tubular members 37, 38, 40 and 41. Extending outwardly and oppositely from the members 37 and 38 are the fastening members 28 which cooperate with the slots 27.

A hook 44 is positioned centrally of the tubular member 40 in a position to be engaged by the end of a rod 43 which a workman may raise to engage the hook 44.

Figure 4:
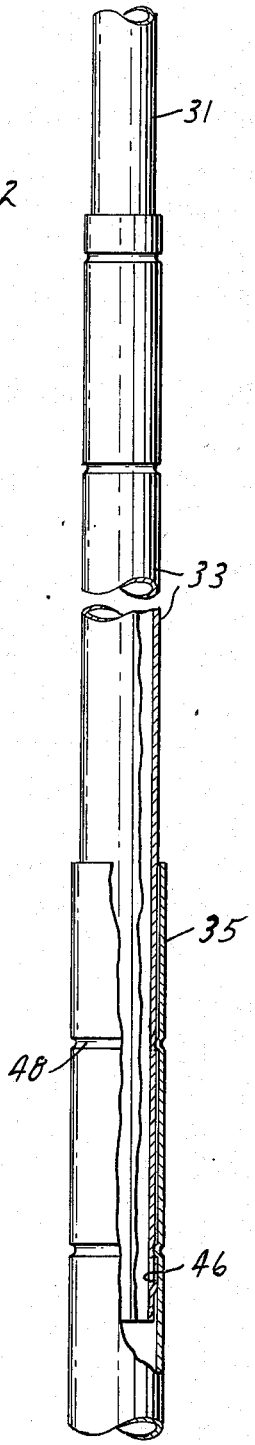
FIG. 4 is a fragmentary sectional view of a portion of the telescoping frame members of the present invention.

As illustrated in FIG. 4, the tubular members are formed with lanced areas 46 which engage ridges 48 extending inwardly and circumferentially around the cooperating telescoping tubes. Thus the extent of the telescoping movement of one tube with respect to the other is limited during the lowering of the secondary frame 17 from the first frame 16. In the preferred embodiment the upper tubes 30 and 31 are fastened to the first frame by means of a pair of cotter pins, one pin on each side of the top flange of the upper frame member 20. The tubes 30 and 31 are ¾ inch in outside diameter, the tubes 32 and 33 being preferably ⅞ inch in outside diameter, the tubes 34 and 35 being 1 inch in outside diameter and the tubes 37 and 38 having an outside diameter of 1⅛ inch. The tubes are positioned behind the front portions of the frame members 20, 21, 22 and 24 and the entire secondary frame 17 will be hidden in its normal position.

To change the photographic transparency 50 on the signboard the operator must merely carry out the new copy material and an elongated telescoping pole 45 having a hook on one end adapted to engage the hook on the lower frame member of the secondary frame. Then by elevating and moving the lower section of the secondary frame 17 toward the panel 11 the fastening means, i.e. pins 28, may be released and the secondary frame 17 may be lowered on the telescoping rail 18 to the ground wherein the resilient fasteners 45 may be loosened from the previous transparency and the new one inserted. The secondary frame 17 may then be elevated again by the rod 45 into the primary frame structure 16 supported on the sign. The photographic transparency 50 may be a screen painted transparency or a photographic reproduction.

Having described the present invention with reference to a preferred embodiment it will be understood that possible modification may be made and not depart from the spirit of the present invention as recited in the appended claims.

I claim:

1. A frame for changeable photographic transparencies of an enlarged size on an elevated signboard comprising in combination:

a primary rectangular frame structure having fastening means thereon for supporting said primary frame on an illuminated sign, a secondary tubular frame having clamp means for supporting therein a photographic transparency, telescoping rails supporting said secondary frame from the upper portion of said primary frame and guiding said secondary frame within the primary frame structure, and fastening means on said secondary frame adjacent the lower edge thereof cooperating with fastening means in the primary frame for locking said secondary frame in the primary frame in the raised position.

2. A frame according to claim 1 wherein said telescoping rails comprise a plurality of telescoping tubes having means for restricting separation.

3. A frame according to claim 2 wherein said tubular frame includes tubular side members and said telescoping tubes of said rails fit into said side members.

4. A frame according to claim 1 wherein said frame structure includes three assembled angle members and a bar connecting the free ends of two angled members to form the fourth side of the frame facade.

* * * * *